US011384586B2

(12) United States Patent
Ahrens et al.

(10) Patent No.: US 11,384,586 B2
(45) **Date of Patent: *Jul. 12, 2022**

(54) ADORNMENT FOR DOOR STOP AND DOOR STOP WITH INTERCHANGEABLE ADORNMENT

(71) Applicants: Jinny Marie Ahrens, Portage, MI (US); Meghan Marie Reynolds Ahrens, Portage, MI (US)

(72) Inventors: Jinny Marie Ahrens, Portage, MI (US); Meghan Marie Reynolds Ahrens, Portage, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/899,316

(22) Filed: Jun. 11, 2020

(65) Prior Publication Data

US 2020/0370354 A1 Nov. 26, 2020

Related U.S. Application Data

(63) Continuation of application No. 16/286,787, filed on Feb. 27, 2019, now Pat. No. 10,697,223, which is a continuation of application No. 15/388,386, filed on Dec. 22, 2016, now Pat. No. 10,240,380.

(60) Provisional application No. 62/270,862, filed on Dec. 22, 2015.

(51) Int. Cl.
*E05F 5/06* (2006.01)

(52) U.S. Cl.
CPC ..... *E05F 5/06* (2013.01); *E05Y 2201/224* (2013.01); *E05Y 2600/52* (2013.01); *E05Y 2600/628* (2013.01); *Y10T 16/61* (2015.01)

(58) Field of Classification Search
CPC ..... E05F 5/06; E05F 5/02; E05F 5/08; Y10T 16/61; Y10T 16/625; Y10T 16/628; Y10T 16/6285; E05Y 2201/224; E05Y 2600/52; E05Y 2600/628; E05C 17/54; E05C 17/44; G09F 2007/1856; F21S 8/033
USPC ..... 16/82, 86 A, 86 R, 85; D8/402; 292/342, 38, DIG. 153; 40/606.07; 362/147
See application file for complete search history.

(56) References Cited

U.S. PATENT DOCUMENTS 1,929,623 A * 10/1933 Chisling ..... E05C 17/50 16/86 A
2,002,725 A * 5/1935 Wyatt ..... G09F 13/34 40/459
2,109,228 A * 2/1938 Carlson ..... E05C 17/525 16/86 A (Continued)

*Primary Examiner* — William L Miller
(74) *Attorney, Agent, or Firm* — Larry E. Henneman, Jr.; Henneman & Associates, PLC

(57) ABSTRACT

A door stop includes an elongated body defining an axis, at least one attachment structure disposed near a first end of the elongated body, and at least one adornment coupler. The adornment coupler can include a channel formed in the elongated body parallel to its axis and having a cross-section in the shape of an inverted "T". The adornment coupler enables different adornments to be interchangeably attached to the door stop. An adornment of the invention includes a decorative portion and a mounting structure coupled to the decorative portion. The mounting structure is configured to removably engage a complementary adornment coupler (e.g., the channel) of the door stop, whereby the adornment can be mounted to the door stop.

19 Claims, 10 Drawing Sheets

(56) References Cited

U.S. PATENT DOCUMENTS 2,189,048 A * 2/1940 Underhill ..... E05F 5/06 16/86 A
2,462,174 A * 2/1949 Fisher ..... E05F 5/06 16/86 A
2,479,597 A * 8/1949 Anton ..... E05F 5/06 16/86 A
2,682,683 A * 7/1954 La Padula ..... E05C 17/443 16/86 C
2,756,527 A * 7/1956 Mease ..... G09F 23/00 40/607.1
2,760,224 A * 8/1956 Hennelly ..... E05F 5/06 16/86 A
5,226,201 A * 7/1993 Lefebvre ..... E05C 17/52 16/82
5,288,257 A * 2/1994 Zacherl ..... A63H 3/36 16/82
5,603,141 A * 2/1997 Gledhill ..... E05F 5/06 16/86 A
6,295,697 B1 * 10/2001 Simon ..... E05F 5/02 16/86 A
D570,678 S * 6/2008 Zhang ..... D8/402
9,267,317 B2 * 2/2016 Vu ..... E05F 5/06
2006/0152019 A1 * 7/2006 Depasquale ..... E05C 17/56 292/251.5
2006/0163888 A1 * 7/2006 Bowser ..... E05C 17/54 292/343
2010/0018003 A1 * 1/2010 Swartz ..... E05F 5/06 16/82
2010/0242226 A1 * 9/2010 Hopkins ..... E05C 17/54 16/82
2012/0144624 A1 * 6/2012 Swartz ..... E05F 5/06 16/82
2013/0255033 A1 * 10/2013 Vu ..... E05F 5/08 16/82
2015/0361706 A1 * 12/2015 Catalano ..... E05F 5/06 16/82
2016/0340957 A1 * 11/2016 Catalano ..... E05F 5/06

* cited by examiner

ADORNMENT FOR DOOR STOP AND DOOR STOP WITH INTERCHANGEABLE ADORNMENT

CROSS-REFERENCE TO RELATED APPLICATIONS

This application is a continuation of co-pending U.S. patent application Ser. No. 16/286,787, filed Feb. 27, 2019 by at least one common inventor, which is a continuation of U.S. patent application Ser. No. 15/388,386, filed Dec. 22, 2016 by at least one common inventor, which claims the benefit of U.S. Provisional Patent Application Ser. No. 62/270,862, filed Dec. 22, 2015 by at least one common inventor, each of which is incorporated herein by reference in its entirety.

BACKGROUND

Field of the Invention

This invention relates generally to door stops, and more particularly to a door stop and one or more interchangeable adornment(s).

Description of the Background Art

Door stops are known. Door stops often mount to a wall or a floor of an architectural structure (e.g., a home, office building, etc.) and stop the movement of a door as it is opened. One common door stop includes a post that mounts to the wall or baseboard near the bottom of the wall. When mounted, the post of the door stop sticks out from the wall by 3-4 inches (7-10 centimeters), which is sufficient to prevent a door handle from striking the wall and causing damage. Another type of door stop maintains a door in an open position.

Prior art door stops are bland and are manufactured to blend in with the décor of a building. Accordingly, prior art door stops are not readily noticed by persons in the building.

SUMMARY

The present invention overcomes the problems associated with the prior art by providing an interchangeable adornment for a door stop and a door stop configured to couple with such interchangeable adornments (e.g., decoration, ornament, sign, etc.). The invention facilitates customization of the door stop according to an occupant's desires and improves the decorative appearance of the door stop and the décor of the architectural structure (e.g., home, etc.).

A door stop according to the invention includes an elongated body defining an axis, at least one attachment structure disposed near a first end of the elongated body, and at least one adornment coupler adapted to removably couple at least one adornment to the door stop adjacent the elongated body. In a particular embodiment, the adornment coupler comprises a predetermined shape formed integrally with the elongated body. More specifically, the predetermined shape is configured to engage a mounting structure of the adornment that defines a second shape that is complementary to the predetermined shape. In a particular example, the adornment coupler comprises a channel formed in the elongated body parallel to its axis, for example, in the shape of an inverted "T".

The attachment structure, in contrast, facilitates the attachment of the elongated body to an architectural structure (e.g., a house, office building, etc.). In a particular embodiment, the attachment structure includes a screw fixed to the elongated body. In another embodiment, the first end of the elongated body includes a base and the attachment feature includes a plurality of apertures defined in the base, which receive fasteners therethrough.

The door stop also includes a bumper adapted to couple to the elongated body near a second end of the elongated body. The bumper is adapted to removably engage the adornment coupler (channel) of the body. In a particular embodiment, the bumper includes a protrusion shaped to be inserted into the channel of the elongated body. The protrusion can have an inverted "T" shape.

In another embodiment, the door stop further includes at least one light source adapted to illuminate the adornment when the adornment is coupled to the door stop. For example, the light source(s) can be disposed to illuminate a channel defined in the elongated body. The door stop can also include at least one power supply terminal (e.g., a battery connector, an electrical plug, etc.) for providing electrical power to the light sources.

The present invention is also directed to an adornment, which can be a stand-alone aspect of the invention, which removably engages the door stop. An adornment according to the invention includes a decorative portion and a mounting structure coupled to the decorative portion generally below the decorative portion. The mounting structure is configured to removably engage a complementary adornment coupler (e.g., the channel in the elongated body) of the door stop such that the mounting structure retains the decorative portion of the adornment in a position along (e.g., above) the elongated body of the door stop.

In a particular embodiment, the mounting structure comprises a predetermined shape. For example, the mounting structure can define a support rail (e.g., in the shape of an inverted "T") that is adapted to slidably engage a channel of the door stop.

A method of manufacturing a door stop according to the invention includes the steps of forming an elongated body, forming an attachment structure adapted to attach the elongated body to an architectural structure, and disposing the attachment structure near a first end of the elongated body. The method also includes providing at least one adornment coupler configured to removably couple at least one adornment to the door stop adjacent the elongated body.

A method of manufacturing an adornment according to the invention includes the steps of forming a decorative portion, forming a mounting structure configured to removably engage a complementary adornment coupling portion of a door stop, and coupling the mounting structure to the decorative portion below the decorative portion, whereby the mounting structure is configured to retain the decorative portion in a position along an elongated body of the door stop.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a wall-mountable door stop that includes at least one adornment coupler for selectively mounting an adornment (e.g., an ornament, decoration, sign, etc.) to the door stop. Additionally, the invention provides an adornment that is configured to be mounted on a door stop. In the following description, numerous specific details are set forth (e.g., shapes of channels, shapes of adornment mounting structures, exemplary screw hole configurations, etc.) in order to provide a thorough understanding of the invention. Those skilled in the art will recognize, however, that the invention may be practiced apart from these specific details. In other instances, details of well-known manufacturing techniques and componentry have been omitted, so as not to unnecessarily obscure the present invention.

Figure 1:
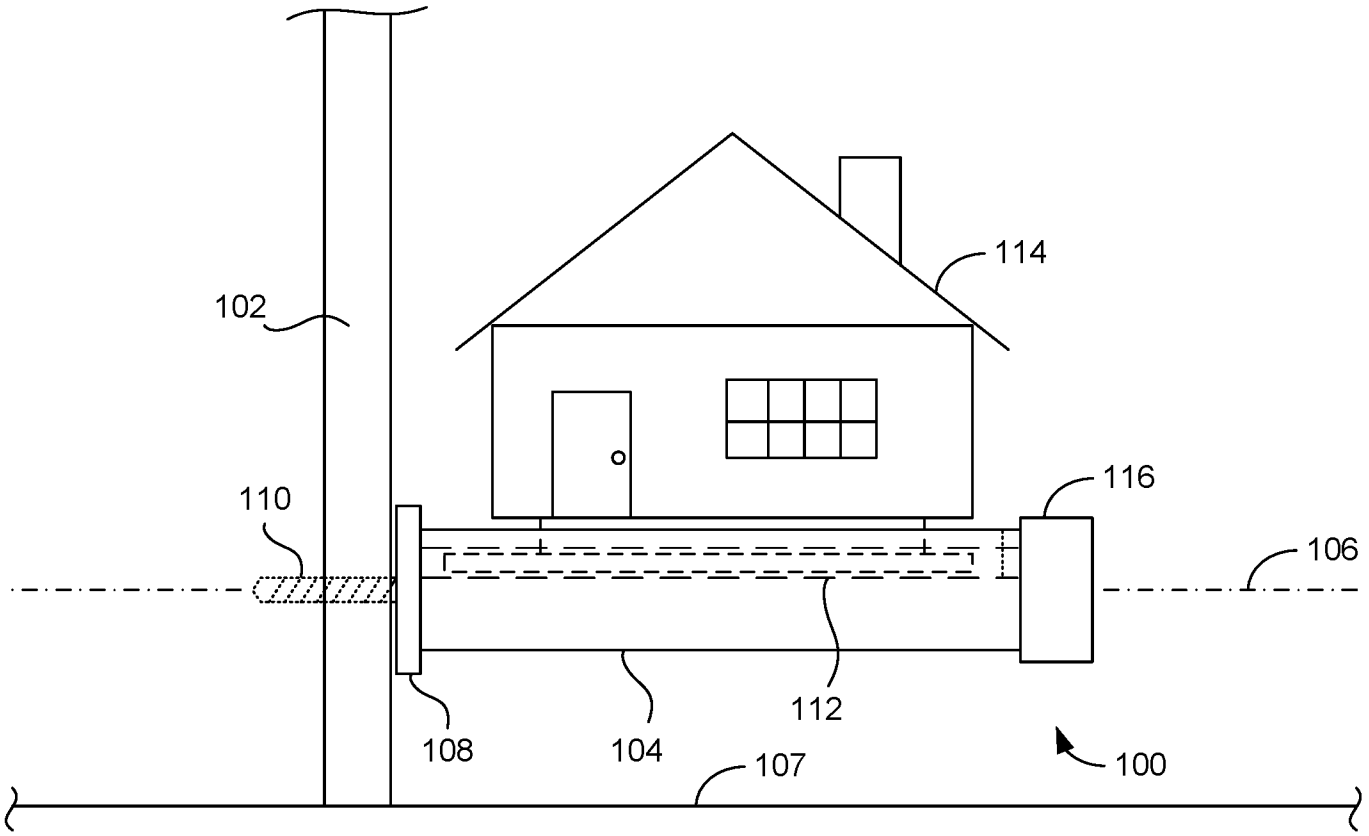
FIG. 1 is a side view of a door stop according to a particular embodiment of the invention.

FIG. 1 is a side view of a door stop 100 mounted to a wall (or baseboard) 102 of a home or other architectural structure. Door stop 100 includes an elongated body 104 defining an axis 106 that is generally parallel to a floor 107 of the home. Body 104 includes an attachment structure disposed near a first end of body 104 for mounting door stop 100 to wall 102. In this embodiment, the attachment structure includes a base 108 and a screw 110 mated (e.g., welded, etc.) to base 108, such that body 104 can be rotated to drive screw 110 into wall 102. Base 108 has a larger perimeter than elongated body 104, such that base 108 can distribute the force exerted by a door impact onto a larger area of wall 102.

Body 104 further includes at least one adornment coupler 112 adapted to removably couple at least one adornment 114 (e.g., an ornament, decoration, sign, etc.) to door stop 100 and to position adornment 114 adjacent to (e.g., above) elongated body 104 and parallel to axis 106. As will be described in more detail below, in this embodiment, adornment coupler 112 includes an inverted (upside-down) "T" channel 112 extending through elongated body 104 parallel to axis 106. As shown, channel 112 extends the majority of the length of elongated body 104.

Door stop 100 also includes a removable bumper 116 that, when removed, provides access to the channel 112 such that adornment 114 can slide into the channel 112 by moving adornment 114 along axis 106. Bumper 116 can then be (re-)installed on the end of body 104 to retain adornment 114 in channel 112.

Figure 2:
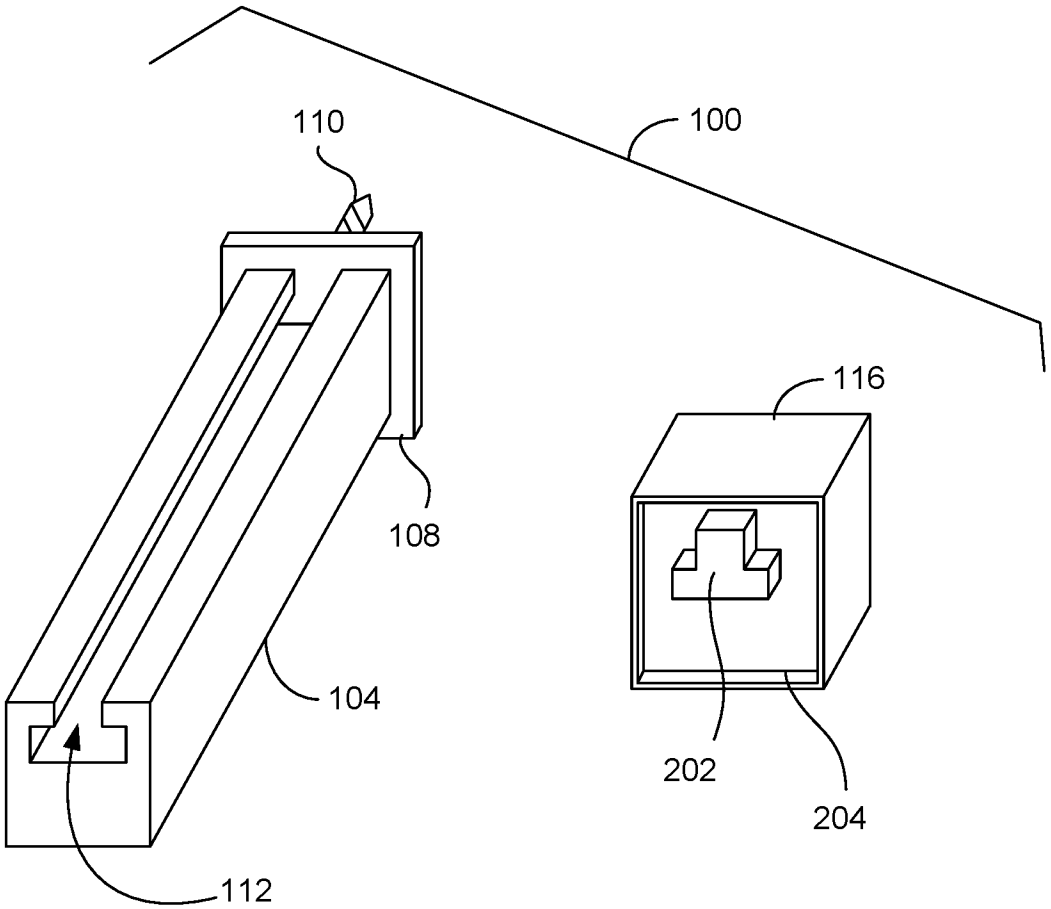
FIG. 2 is a perspective view of the door stop of FIG. 1 with the adornment removed.

FIG. 2 is a perspective view of door stop 100 with bumper 116 and adornment 114 removed from elongated body 104. FIG. 2 shows that channel 112 is an inverted "T" channel that is configured to receive a complementary feature of adornment 114 therein. Once adornment 114 is slid into channel 112, bumper 116 can be re-installed over the distal end of elongated body 104 to retain adornment 114 in position and to act as a bumper against a swinging door.

As shown, bumper 116 includes a protrusion 202 in the shape of an inverted "T", which is inserted into the end of channel 112 to retain bumper 116 in position when installed on elongated body 104. Bumper 116 also includes a lip 204 around its perimeter, wherein the lip 204 is configured to surround elongated body 104 when bumper 116 is installed thereon. The lip improves the finished appearance of door stop 100 and further helps to retain bumper 116 in position.

Figure 3B:
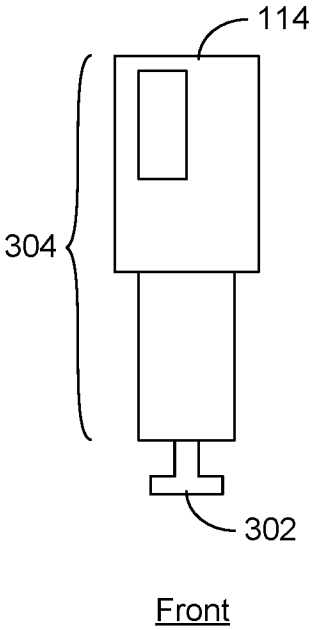
FIGS. 3A and 3B are side and front views, respectively, of an adornment for a door stop according to the present invention.
Figure 3A:
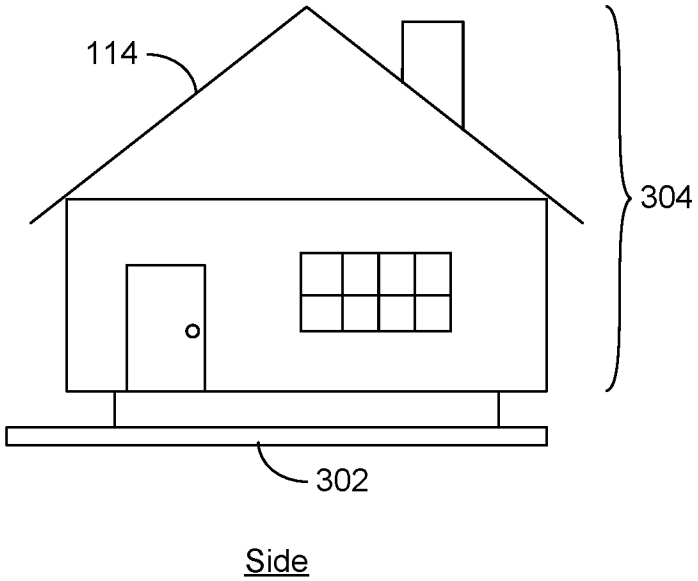

FIGS. 3A and 3B show side and front views, respectively, of adornment 114. As shown, adornment 114 includes a mounting structure 302 that is configured to removably engage channel 112 of door stop 100 and position and support a decorative portion 304 of adornment 114 above and along elongated body 104. In this example, decorative portion 304 is an ornament in the shape of a house. As shown in FIG. 3A, mounting structure 302 is a rail that extends along the width of adornment 114. Furthermore, FIG. 3B shows that the rail 302 is in the shape of an inverted "T", such that rail 302 is complementary to the shape of channel 112 so that it is easily received thereby. Furthermore, the inverted "T" shape of rail 302 prevents adornment 114 from pulling out of channel 112 vertically. While channel 112 facilitates attachment of adornment 114 to body 104 of door stop 100 in the current example, other means (e.g., clips, magnets, etc.) could be used to couple adornment 114 to body 104 instead of, or in addition to, channel 112.

Figure 4:
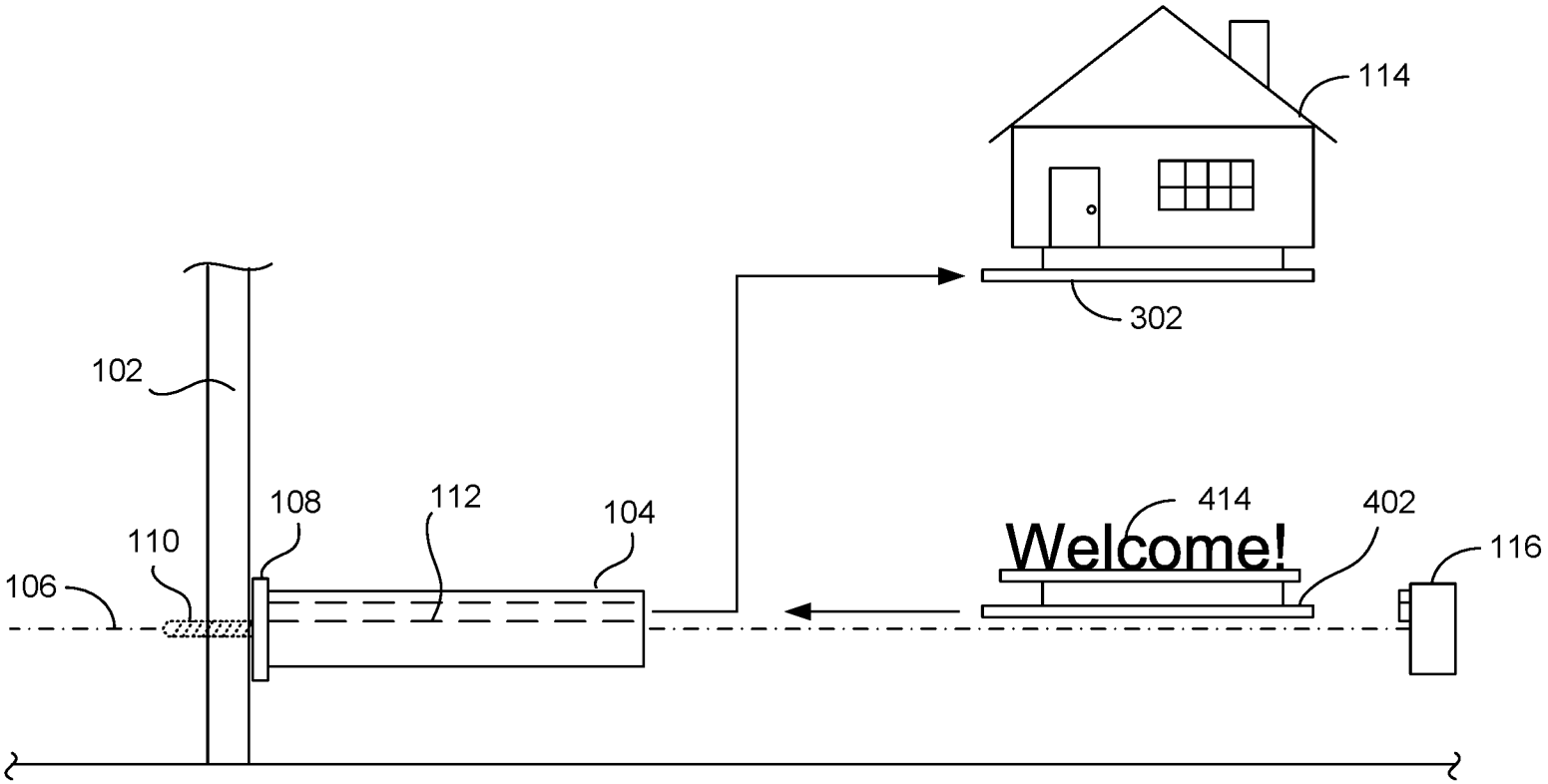
FIG. 4 is a diagram illustrating the procedure for removing and installing adornments from the door stop of FIG. 1.

FIG. 4 is a diagram illustrating a procedure for removing and installing adornments on door stop 100. In FIG. 4, bumper 116 has been removed by pulling bumper 116 away from elongated body 104 in a direction parallel to axis 106. Thereafter, adornment 114 can be slid out of channel 112 by pulling adornment 114 away from body 104 in a direction parallel to axis 106 until rail 302 is completely withdrawn from channel 112. Then a new adornment 414 (a "Welcome" sign) can be installed in door stop 100 by sliding its rail 402 into channel 112 in a direction toward body 104 and parallel to axis 106. (The shape of rail 402 is substantially the same as rail 302.)

The door stop 100 of the invention provides the advantage that adornments 114 can be selectively and interchangeably installed on the door stop 100 as desired by the home owner. Additionally, the adornments 114 can improve the décor of the home. As an example, the home owner might desire to change the adornments 114 depending on holiday or season, to reflect their favorite sports teams, etc. As another example, the adornments 114 might include decorative or useful signage (e.g., greetings, room numbers, etc.) that can be changed as desired. As yet another example, the adornment 114 can even be custom made (e.g., whittled from wood) by the home owner.

Figure 5:
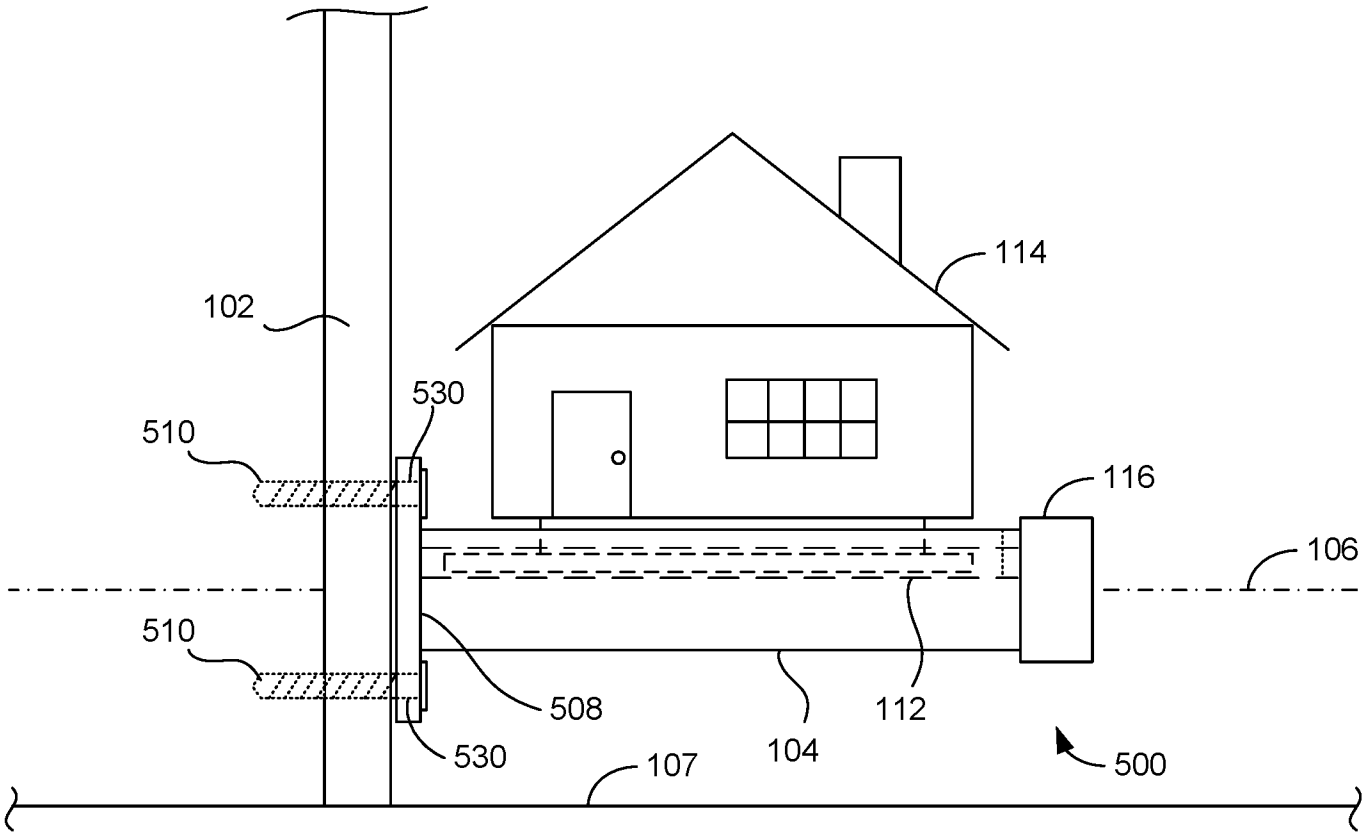
FIG. 5 is a side view of a door stop according to another embodiment of the present invention.

FIG. 5 is a side view of a door stop 500 according to an alternative embodiment of the present invention. Door stop 500 is similar to door stop 100, except that it includes an alternative base 508 that receives a plurality of fasteners (e.g., screws) 510 therethrough to mount door stop 500 to wall 102. In particular, base 508 defines a plurality of apertures 530 therethrough that receive fasteners 510. Apertures 530 are positioned above and below elongated body 104 such that fasteners 510 can be installed in apertures 530 with a long screw driver. Using apertures 530 and fasteners 510, instead of a screw fixed to the base (e.g., screw 110) provides the advantage that door stop 500 to be easily installed on wall 102 in a position that ensures adornment 114 will be oriented vertically with respect to floor 107.

Figure 6B:
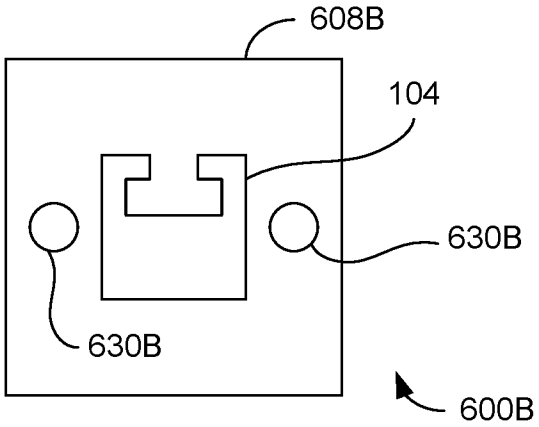
FIGS. 6A-6E are front views of various embodiments of door stops according to the present invention.
Figure 6A:
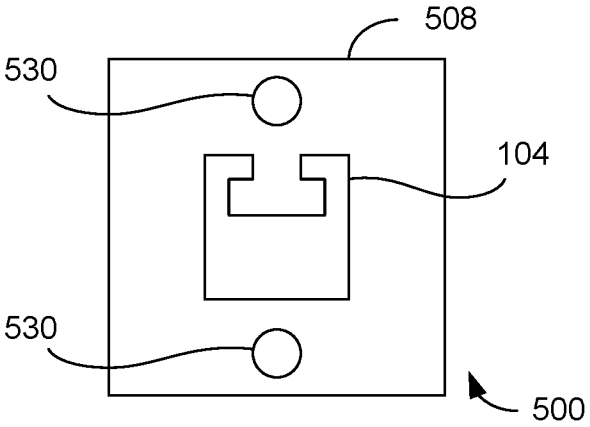
Figure 6E:
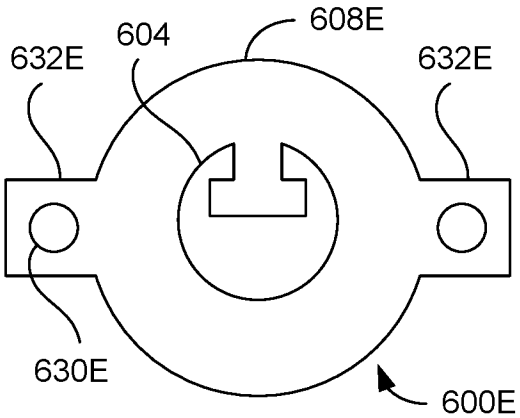
Figure 6D:
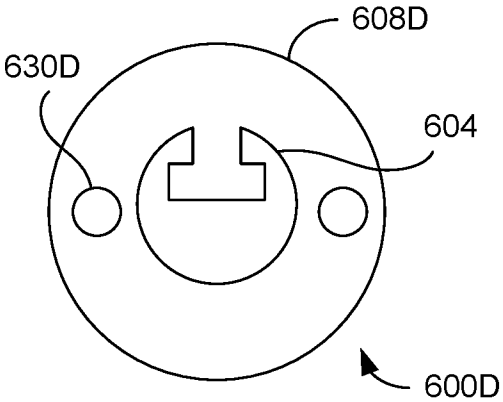
Figure 6C:
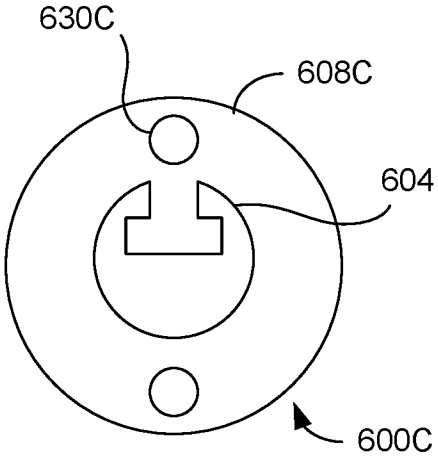

FIGS. 6A-6E are front views of various embodiments of door stops according to the present invention (with bumpers removed) that provide the mounting advantage discussed above in FIG. 5. FIG. 6A shows a front view (looking down axis 106 toward wall 102) of door stop 500 of FIG. 5, which shows the locations of apertures 530 in more detail. FIG. 6B shows a door stop 600B that is similar to door stop 500, except that it has two screw-receiving apertures 630B oriented horizontally across a square base 608B. FIG. 6C shows a door stop 600C that includes two screw-receiving apertures 630C oriented vertically and formed through a circular base 608C. Additionally, door stop 600C includes a generally cylindrical (or alternatively conical) elongated body 604. FIG. 6D shows a door stop 600D that includes two screw-receiving apertures 630D oriented horizontally and formed through a circular base 608D. Door stop 600D also includes a cylindrical elongated body 604. FIG. 6E shows a door stop 600D that includes two screw-receiving apertures 630E, each of which is formed through a respective wing 632E of base 608E. Door stop 600E also includes a cylindrical elongated body 604.

FIGS. 6A-6E illustrate that the elongated body and/or base of the door stops of the present invention can be made in any desirable shape. Similarly, the shapes and dimensions of the other elements (e.g., channels, bumpers, etc.) of the door stops described herein can be altered as desired without departing from the scope of the present invention.

Figure 7:
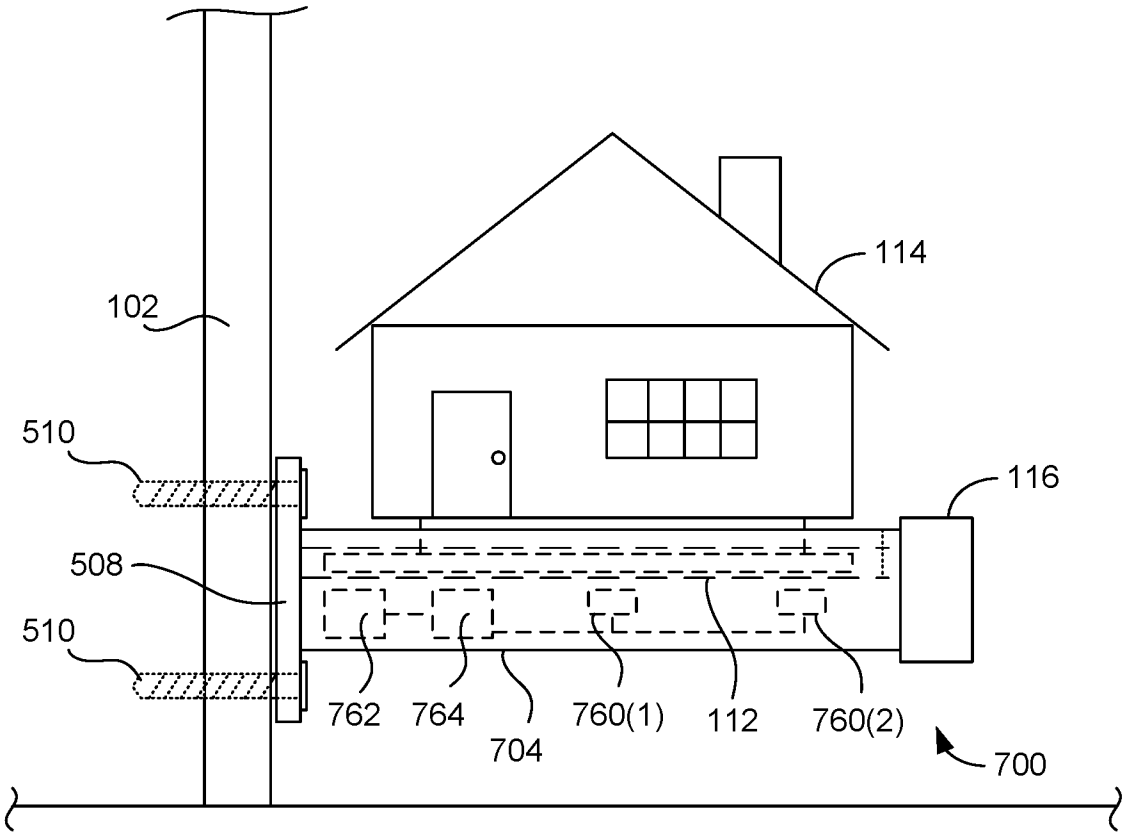
FIG. 7 is a side view of a door stop including light source componentry, according to yet another embodiment of the present invention.

FIG. 7 is a side view of a door stop 700 according to yet another embodiment of the present invention. Door stop 700 is similar to door stop 500, but is modified to include a body 704 that houses one or more light sources 760(1-*n*) (two are shown in FIG. 7), a power source 762, and a controller 764. Light sources 760 are coupled to body 704 so that they illuminate adornment 114, optionally via channel 112, when powered. This enables door stop 700 to function as a night light.

The light source componentry of door stop 700 is shown representationally in FIG. 7. Power source 762 (e.g., a replaceable battery, one or more power supply terminals, etc.) provides electrical power to controller 764. Controller 764 (e.g., circuitry) selectively provides electrical power (e.g., responsive to an ambient light sensor or switch) to any of light sources 760(1-*n*). In the present embodiment, light sources 760(1-*n*) are light emitting diodes (LEDs).

Figure 8:
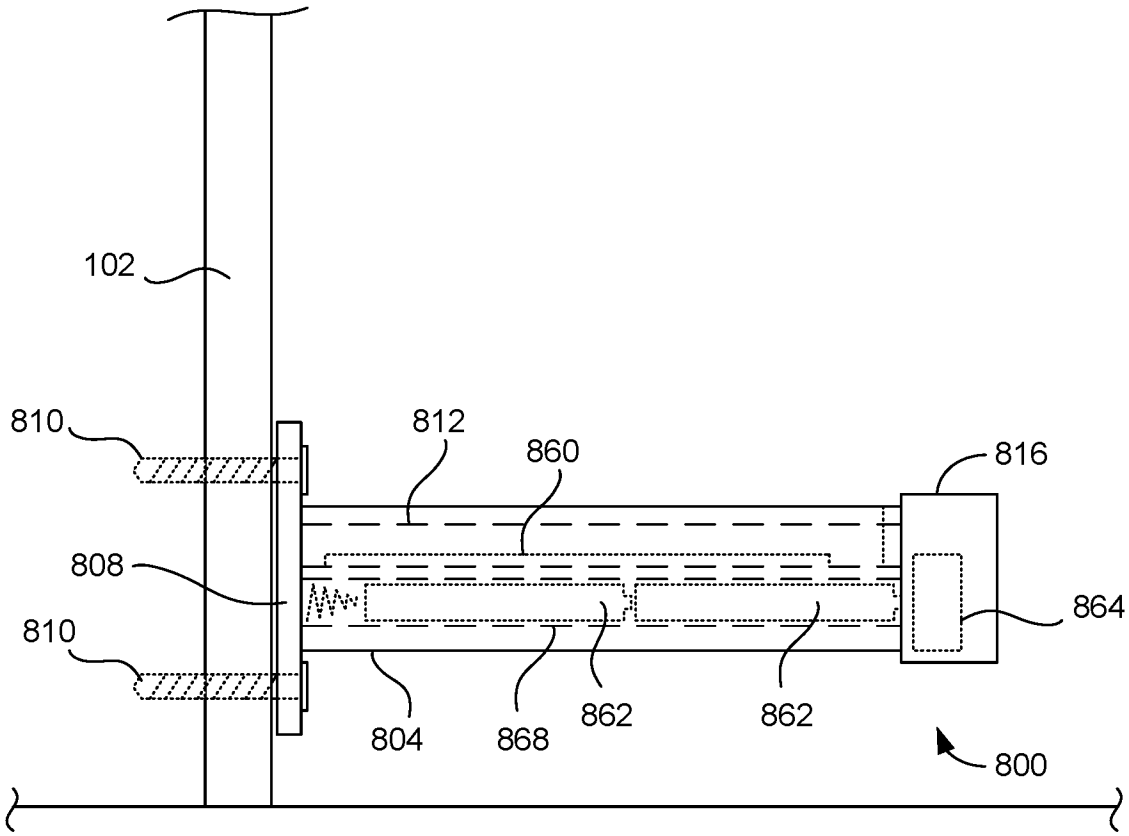
FIG. 8 is a side view of a door stop with light source componentry according to still another embodiment of the present invention.

FIG. 8 is a side view of another door stop 800 with light source componentry. Door stop 800 is similar to prior embodiments in that it includes an elongated body 804, a base 808 fixed to wall 102 with screws 810, and a channel 812 formed in elongated body 804 to receive an adornment, such as adornment 114. However, door stop 800 also includes an LED strip 860 that selectively illuminates channel 812 and, in turn, adornment 114. Electrical power is provided to LED strip 860 from batteries 862 disposed in a cavity 868 formed in body 804. In FIG. 8, bumper 816 includes circuitry 864 that completes a circuit (not shown) between batteries 862 and LED strip 860 when bumper 816 is installed on body 804.

It should be understood that the light source componentry described in FIGS. 7-8 is exemplary in nature and modifications thereto are within the scope of the present invention. For example, the invention may be practiced with only one light source. As another example, the door stop can be configured to plug into a power receptacle located near the door stop. As yet another example, componentry (e.g., batteries) may be moved to other locations (e.g., in bumper 816, in a cartridge, etc.) These and other deviations from the embodiments described are certainly within the scope of the present invention.

The door stops and adornments of the present invention can be manufactured using any of various techniques (e.g., casting, extruding, milling, drilling, molding, 3-D printing, etc.) known to those skilled in the art. For example, the elongated bodies and bases described herein can be cast or extruded from metal, or molded from a curable resin, with or without their channels formed therein. If without, the channels can thereafter be milled into the elongated body. Additionally, screw-receiving apertures can be drilled through the bases of the elongated body or a screw can be welded onto metal body. The bumpers described herein can be formed by molding rubber or some other resilient material into the desired shape. Similarly, adornments can also be formed from a plastic by molding or from a metal by, for example, stamping, plasma cutting, water-jetting, etc. The light source componentry described herein can also be supplied as one or more components or modules to be joined with an elongated body or bumper of a door stop, for example, by insertion, gluing, molding, etc. Indeed, these methods are only examples and other techniques or combinations of techniques can be used.

Some exemplary methods associated with the present invention will now be described with reference to FIGS. 9-10. For the sake of clear explanation, these methods might be described with reference to particular elements of the previously-described embodiments. However, it should be noted that other elements, whether explicitly described herein or created in view of the present disclosure, could be substituted for those cited without departing from the scope of the present invention. Therefore, it should be understood that the methods of the present invention are not limited to any particular elements that perform any particular functions. Furthermore, some steps of the methods presented herein need not necessarily occur in the order shown. For example, in some cases two or more method steps may occur simultaneously. These and other variations of the methods disclosed herein will be readily apparent, especially in view of the description of the present invention provided previously herein, and are considered to be within the full scope of the invention.

Figure 9:
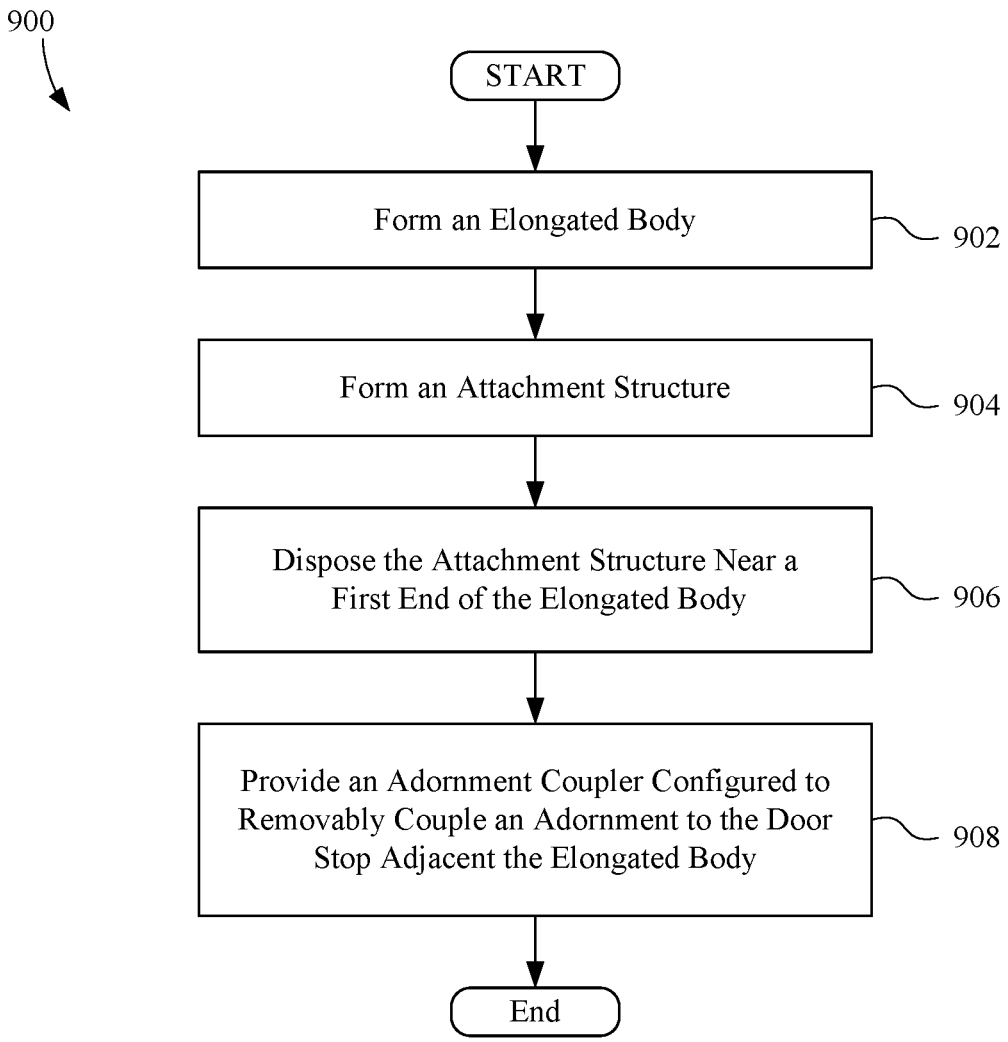
FIG. 9 is a flowchart summarizing a method of manufacturing a door stop according to the present invention.

FIG. 9 is a flowchart summarizing a method 900 of manufacturing a door stop according to the present invention. In a first step 902 an elongated body is formed, and in a second step 904, an attachment structure is formed, where the attachment structure is adapted to attach the elongated body to an architectural structure. In a third step 906, the attachment structure is disposed near a first end of the elongated body. In a fourth step 908, at least one adornment coupler is provided that is configured to removably couple at least one adornment to the door stop adjacent the elongated body.

Figure 10:
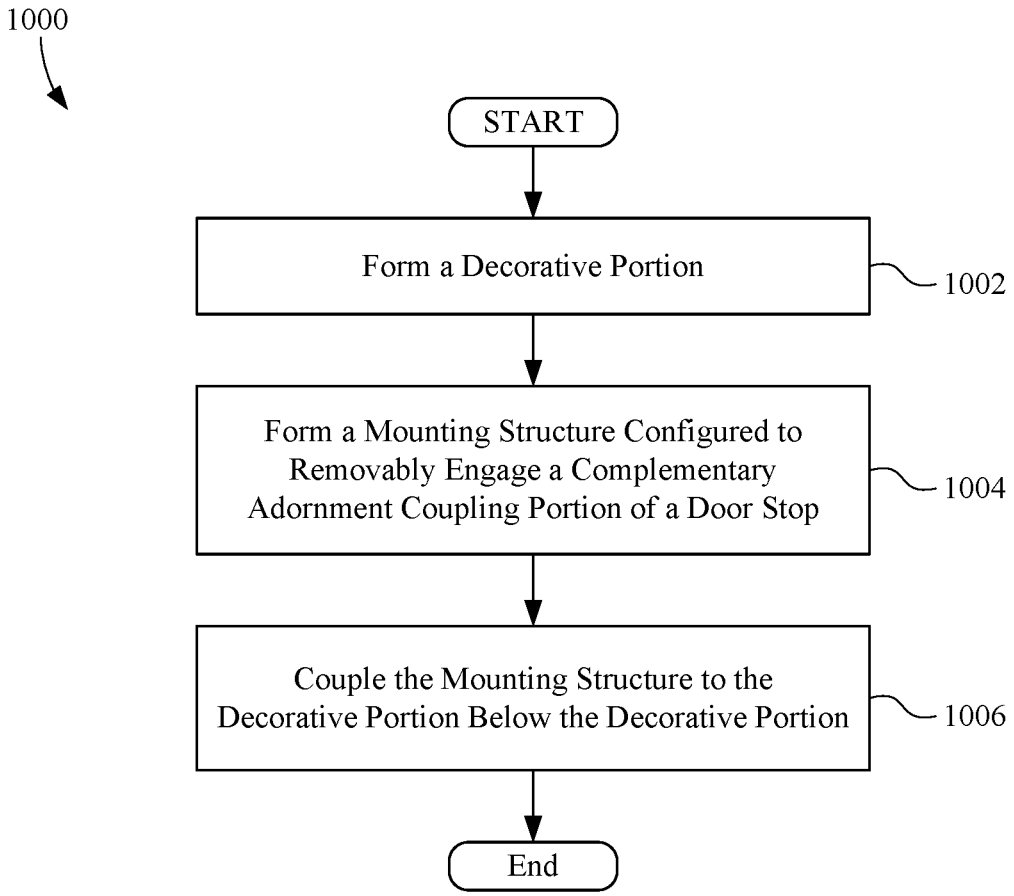
FIG. 10 is a flowchart summarizing a method of manufacturing an adornment according to the present invention.

FIG. 10 is a flowchart summarizing a method 1000 of manufacturing an adornment according to the present invention. In a first step 1002, a decorative portion of the adornment is formed. In a second step 1004, a mounting structure is formed, where the mounting structure is configured to removably engage a complementary adornment coupling portion of a door stop. In a third step 1006, the mounting structure is coupled to the decorative portion generally below the decorative portion, whereby the mounting structure is configured to retain the decorative portion in a position along the elongated body of the door stop.

The description of particular embodiments of the present invention is now complete. Many of the described features may be substituted, altered or omitted without departing from the scope of the invention. For example, alternate shapes of channels (e.g., circular, triangular, etc.) may be substituted for the inverted "T" channel shown. As another example, any of a variety of adornments (e.g., superheroes, college teams, homemade, etc.) may be used with the door stops of the present invention. As yet another example, a door stop can include means (e.g., a plurality of channels, etc.) for attaching multiple adornments to the same door stop. These and other deviations from the particular embodiments shown will be apparent to those skilled in the art, particularly in view of the foregoing disclosure.

We claim:

1. A door stop comprising:

an elongated body defining an axis and having a first end and a second end;

at least one attachment structure disposed at said first end of said elongated body, said attachment structure facilitating the attachment of said elongated body to an architectural structure;

at least one adornment coupler disposed in said elongated body, between said first end and said second end, and configured to removably receive a complementary adornment coupler of at least one adornment therein, whereby said adornment can be selectively mounted to or removed from said elongated body; and at least one light source adapted to illuminate said adornment when said adornment is coupled to said door stop; and wherein said at least one adornment coupler comprises a channel formed in said elongated body; and said at least one light source is disposed to illuminate said channel.

2. The door stop of claim 1, wherein said channel extends through said body parallel to said axis.

3. The door stop of claim 2, wherein a cross-section of said channel has the shape of an inverted T.

4. The door stop of claim 1, wherein a cross-section of said channel has the shape of an inverted "T".

5. The door stop of claim 1, further comprising a bumper adapted to couple to said elongated body near said second end of said elongated body.

6. The door stop of claim 5, wherein:

said bumper is adapted to removably engage said channel.

7. The door stop of claim 5, wherein said bumper is adapted to removably engage said at least one adornment coupler.

8. The door stop of claim 7, wherein:

a cross-section of said channel has a particular shape; and said bumper includes a protrusion having said particular shape, said protrusion being adapted to be inserted into said channel.

9. The door stop of claim 8, wherein said particular shape is an inverted "T" shape.

10. The door stop of claim 5, wherein said bumper is disposed to contact a door when said adornment is coupled to said door stop.

11. The door stop of claim 1, wherein said at least one attachment structure comprises a screw coupled to said first end of said elongated body parallel to said axis.

12. The door stop of claim 1, wherein:

said first end of said elongated body includes a base having a cross-section perpendicular to said axis that is larger than a cross-section of said elongated body perpendicular to said axis; and said at least one attachment structure comprises a plurality of apertures defined in said base outside a perimeter of said cross-section of said elongated body, each of said apertures facilitating the passage of a fastener therethrough.

13. The door stop of claim 1, further comprising said adornment.

14. The door stop of claim 13, wherein:

said adornment comprises said complementary adornment coupler;

said complementary adornment coupler is complementary to said at least one adornment coupler; and said complementary adornment coupler is adapted to removably engage said at least one adornment coupler, whereby said adornment is capable of being removably mounted to said elongated body.

15. The door stop of claim 1, further comprising at least one power supply terminal for providing electrical power to said at least one light source.

16. The door stop of claim 1, wherein said adornment coupler comprises a predetermined shape formed integrally with said elongated body.

17. The door stop of claim 16, wherein:

said predetermined shape is configured to engage said complementary adornment coupler of said adornment; and said complementary adornment coupler of said adornment defines a second shape that is complementary to said predetermined shape.

18. A door stop comprising:

an elongated body defining an axis and having a first end and a second end;

at least one attachment structure disposed at said first end of said elongated body, said attachment structure facilitating the attachment of said elongated body to an architectural structure;

at least one adornment coupler disposed in said elongated body, between said first end and said second end, and configured to removably receive a complementary adornment coupler of at least one adornment therein, whereby said adornment can be selectively mounted to or removed from said elongated body; and a bumper adapted to couple to said elongated body near said second end of said elongated body, said bumper being adapted to removably engage said at least one adornment coupler.

19. A door stop comprising:

an elongated body defining an axis and having a first end and a second end;

at least one attachment structure disposed at said first end of said elongated body, said attachment structure facilitating the attachment of said elongated body to an architectural structure;

at least one adornment coupler disposed in said elongated body, between said first end and said second end, and configured to removably receive a complementary adornment coupler of at least one adornment therein, whereby said adornment can be selectively mounted to or removed from said elongated body; and a bumper adapted to couple to said elongated body near said second end of said elongated body, said bumper being disposed to contact a door when said adornment is coupled to said door stop.

* * * * *